United States Patent [19]

Mochizuki et al.

[11] 4,100,884

[45] Jul. 18, 1978

[54] RUBBER DEVELOPER ROLLER USING SINGLE COMPONENT TONER

[75] Inventors: Nobuo Mochizuki, Matsudo; Hiromi Demizu, Yokohama, both of Japan

[73] Assignee: Ricoh Company, Ltd., Tokyo, Japan

[21] Appl. No.: 768,828

[22] Filed: Feb. 15, 1977

[30] Foreign Application Priority Data

| | | | |
|---|---|---|---|
| Feb. 25, 1976 | [JP] | Japan | 51-19542 |
| Apr. 13, 1976 | [JP] | Japan | 51-41469 |
| May 26, 1976 | [JP] | Japan | 51-60831 |

[51] Int. Cl.[2] ..... G03G 15/08

[52] U.S. Cl. ..... 118/653; 118/658; 118/651

[58] Field of Search ..... 118/658, 651, 661, 656, 118/657, 652, 653; 427/18

[56] References Cited

U.S. PATENT DOCUMENTS

| | | | |
|---|---|---|---|
| 2,944,147 | 7/1960 | Bolton | 118/651 X |
| 3,176,652 | 4/1965 | Mott et al. | 118/658 |
| 3,357,403 | 12/1967 | Donalies | 118/651 X |
| 3,542,466 | 11/1970 | Fox | 118/656 X |
| 3,696,783 | 10/1972 | Fantuzzo | 118/652 |
| 3,703,459 | 11/1972 | Little, Jr. et al. | 118/661 X |
| 3,863,603 | 2/1975 | Buckley et al. | 118/658 |
| 3,882,822 | 5/1975 | Sullivan | 118/657 X |
| 3,889,637 | 6/1975 | North et al. | 118/651 |
| 3,950,089 | 4/1976 | Fraser et al. | 118/651 X |
| 3,999,515 | 12/1976 | Weiler | 118/651 |
| 4,003,334 | 1/1977 | Samuels et al. | 427/18 |
| 4,026,241 | 5/1977 | Takebe et al. | 118/658 X |
| 4,033,293 | 7/1977 | Ohmori et al. | 118/653 |
| 4,036,175 | 7/1977 | Phillips et al. | 118/653 |

*Primary Examiner*—Mervin Stein
*Assistant Examiner*—Andrew M. Falik
*Attorney, Agent, or Firm*—Cooper, Dunham, Clark, Griffin & Moran

[57] ABSTRACT

An apparatus for developing an electrostatic image on a photosensitive member or on a record member using one-component developer is provided. The developer comprises a magnetic toner or non-magnetic toner having a volumetric resistivity of not less than $10^6\Omega$cm. The apparatus comprises a developing roller at least the surface portion of which is formed of elastic rubber, means for supplying toner to the surface of the developing roller, and means for charging the toner on the developing roller to a given polarity. The developing roller is driven for rotation at a peripheral speed which is equal to or greater than the speed of movement of the image carrying member. Additionally, the apparatus includes levelling means for levelling the toner on the developing roller, charge neutralizing means for eliminating the electric charge from the toner after the developing step, and scraper means for stirring the toner after the developing step. Various modifications and limitations of the means and members mentioned are possible.

19 Claims, 6 Drawing Figures

RUBBER DEVELOPER ROLLER USING SINGLE COMPONENT TONER

BACKGROUND OF THE INVENTION

The invention relates to an apparatus for developing an electrostatic latent image formed on an image bearing member such as photosensitive member or record member, and in particular to such apparatus which utilizes one-component developer without requiring the use of a carrier.

A developing apparatus using one-component developer is known, see, for example, U.S. Pat. Nos. 3,093,039 and 3,909,258 which may utilize a magnetic toner of either high or low resistivity. When magnetic toner of low resistivity is used, the low resistivity prevents charging of the toner, so that the toner is attracted to the electrostatic image by electrostatic induction. Because the toner itself is not charged, it is inadequate for use with an image of low potential. In general, the use of a magnetic toner facilitates transportation of the toner since it may be magnetically attracted to the surface of a developing roller under the influence of a magnet, but requires, for the fixing of the developed toner image, an increased amount of heat as high as 1.5 to 2 times the heat quantity required for normal toner particles alone as a result of the presence of a magnetic powder, such as iron powder which has a relatively high heat capacity in admixture with the toner. This presents difficulties with respect to operational safety and high speed copying operations. With a non-magnetic toner, the toner can be charged to assure full developing of an image of low potential. However, since the toner has no magnetic property, magnetic attraction cannot be utilized for the conveyance thereof, and the absence of a stirring action under the magnetic influence tends to cause agglomeration of the toner, resulting in a nonuniformity in the charging and developing effects. While both magnetic and non-magnetic toners as one-component developers have certain drawbacks and advantages, they do not require the use of a carrier, thus dispensing with the need to control the density of the developer, and also facilitating the handling of the developer. As a consequence, the present trend is toward the use of one-component developer in preference to two-component developer.

There remains the problem of determining whether the magnetic or non-magnetic toner is more advantageous for use as one-component developer. While a general conclusion cannot be drawn since they are advantageous and disadvantageous in respective different aspects, it can be seen that a toner of low resistivity does not lend itself to the developing of an electrostatic image having an increased proportion of thin lines without some special provision, as a result of the inability of charging such toner.

SUMMARY OF THE INVENTION

A developing apparatus according to the invention employs either a magnetic or non-magnetic toner having a volumetric resistivity of not less than $10^6\Omega$cm as the developer. Where a magnetic toner is used, a plurality of magnets are provided within the internal space of the developing roller. At least the surface portion of the developing roller is formed of elastic rubber. The surface formed of elastic rubber has good adherence and retention qualities for fine powder, so that no serious difficulty is experienced in conveying a non-magnetic toner. The toner is supplied to the developing roller, and is conveyed as the roller rotates. Subsequently, the toner is charged by charging means to the opposite polarity from the polarity of the electric charge which forms an electrostatic image. The toner on the roller is brought into contact with the electrostatic image on the image bearing member, thus converting it into a visual image. The ratio of the peripheral speed of the developing roller to the speed of movement of the image bearing member is made equal to or greater than 1.0.

Additionally, the developing apparatus according to the invention comprises levelling means for levelling the toner supplied onto the developing roller, charge neutralizing means for eliminating the electric charge from the toner on the roller subsequent to the developing step, and a scraper member disposed within toner supply means for causing a deposition of the toner after the toner layer formed on the developing roller is once stirred.

It is preferred from the standpoint of toner supply that the elastic rubber on the roller surface contain a releasing additive such as silicone oil, for example, which has high releasing effect upon the toner. Also, it is preferred from the standpoint of conveying the toner that the elastic rubber have a smooth surface with a high coefficient of friction. Silicone rubber is suitable as an elastic rubber which satisfies these requirements. The developing roller may be made electrically conductive and applied with a bias voltage so as to be used as a counter electrode.

Charging means may comprise a triboelectric charging member, corona discharger or scorotron discharger. When used, the triboelectric charging member is arranged so that a clear surface is always available for frictional contact in order to assure a sufficient charging effect. A developed image of highest quality is obtained for a ratio of relative movement between the developing roller and the image bearing member which is approximately 2.

Therefore, it is an object of the invention to provide an improved apparatus for developing an electrostatic image which employs one-component developer.

It is another object of the invention to provide such apparatus which eliminates the described disadvantages involved with magnetic and non-magnetic toners.

It is a further object of the invention to provide such apparatus which employs one-component developer having a volumetric resistivity of not less than $10^6\Omega$cm.

It is still another object of the invention to provide such apparatus having a developing roller at least the surface of which is formed of elastic rubber.

It is still a further object of the invention to provide such apparatus including means for charging one-component developer to a given polarity.

It is still another object of the invention to provide such apparatus in which the ratio of the peripheral speed of the developing roller to the speed of movement of the image bearing member is equal to or greater than unity.

Further objects and advantages of the invention will become apparent from the following description with reference to the drawings.

DETAILED DESCRIPTION OF PREFERRED EMBODIMENTS

Figure 1:
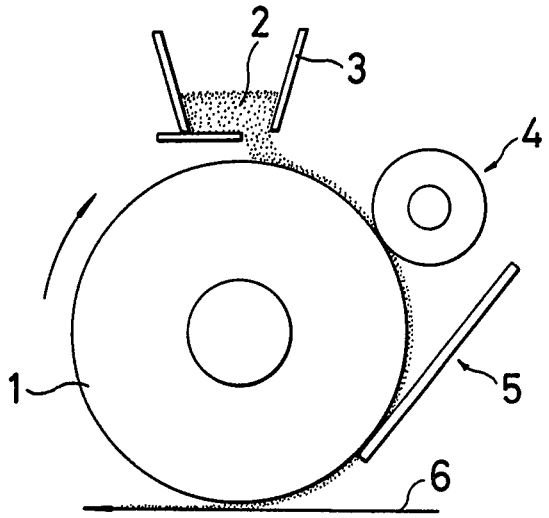
FIG. 1 is a schematic view of an apparatus according to one embodiment of the invention.

Referring to FIG. 1, there is shown a developing roller in the form of a rubber roller 1 rotating in the direction indicated by an arrow. A hopper 3 is disposed above the roller and contains a quantity of insulating, non-magnetic toner 2 having a specific resistivity of not less than $10^6\Omega$cm. The hopper 3 is formed with a bottom opening, through which toner 2 is supplied onto the rubber roller 1. Because the toner 2 is in the form of powder, it is readily attached to the surface to the roller 1, forming a toner layer thereon.

As the roller 1 rotates, the toner layer is conveyed and levelled by a levelling member 4 which is disposed next to the hopper 3 close to or in gentle contact with the roller surface 1. The toner 2 contained within the hopper 3 tends to agglomerate by absorption of humidity or the like, and hence may be deposited on the roller surface in the form of agglomerations. Additionally, the thickness of the toner layer as it is directly applied onto the drum surface from the hopper opening greatly varies from time to time, giving rise to non-uniformity in the charging and developing effects if the toner layer is directly charged or directly used for developing. The purpose of the levelling member 4 is to remove agglomerations of the toner and to provide a uniform thickness of the toner layer.

The toner layer thus formed on the roller 1 to a uniform thickness is scrubbed by a triboelectric charging member 5 to be charged to a given polarity. The member 5 has a contact region which is maintained in contact with the roller surface. The charged toner is then conveyed into contact with an electrostatic latent image on an image bearing member 6, which moves in the direction of an arrow, at a developing position below the roller 1, thus converting the latent image into a visual image. Subsequent to the developing step, the toner layer continues to be conveyed into a region below the hopper 3, from which a supplemental supply of fresh toner is provided through the opening in the hopper.

It is necessary that the surface of the rubber roller 1 has a coefficient of friction with respect to the toner which is not less than 0.5 or preferably not less than 1.0. It is preferred that the rubber roller 1 has a surface roughness from 3 to 10 microns when the particle size of the toner is on the order of 10 microns. Above a surface roughness of 10 microns, unevenness will be produced in the toner layer even though the adherence or the conveyance capability of the toner is improved. In a developing apparatus as contemplated in the present invention, a contact between the toner layer and the image bearing member 6 cannot be achieved under pressure, so that any unevenness formed in the toner layer prevents a uniform deposition of the toner onto the image areas, resulting in a developed image of poor sharpness and reduced resolving power. When the surface roughness is reduced below 3 microns, difficulty may be experienced in conveying the toner.

Additionally, it is essential that the roller 1 be formed of an elastic body. An increased hardness of the roller results in a reduced area of contact between the roller and the levelling member 4 or the triboelectric charging member and thus the frictional force is reduced. In addition, the pressure of contact in the contact region will be increased, resulting in scraping the toner off the roller surface to prevent a satisfactory conveyance and deposition of the toner by the roller 1. A satisfactory toner conveyance and deposition can be achieved by forming the roller 1 of an elastic body having a given hardness, which is preferably on the order of JIS 30° to 40°. When the developing roller is formed of an elastic body at least in its surface region, the area of contact can be increased. Though this reduces the pressure of contact, its relatively high coefficient of friction and its large area of contact contribute to increasing the frictional force, thus assuring a satisfactory toner conveyance capability for deposition, A suitable elastic material for this purpose includes a silicone rubber, chloroprene or the like. It is also possible to use an electrically conductive rubber roller, which may be applied with a bias voltage for effectively performing a biased developing with one-component developer.

The levelling member 4 may be electrically conductive or insulating, and is disposed in gentle contact with the rubber roller 1 or very close thereto with a gap of less than 100 microns. The levelling member 4 may be in the form of a roller as shown or may have any other suitable configuration. Where the levelling member is in the form of a roller, it is preferred that it be held stationary and have a surface roughness which is on the same order of roughness as the rubber roller 1. While the levelling member 4 may be rotated in the same direction as or in the opposite direction from the direction of rotation of the rubber roller 1, due consideration should be paid to prevent the scraping off of the toner layer from the roller surface. A material for the levelling member 4 should be chosen so that it does not interfere with the charging of the toner to a given polarity by the triboelectric charging member 5. Preferably, the material of the levelling member 4 is ranked the same as the toner material or in the vicinity of the charging member in the triboelectric series.

The material of the triboelectric charging member 5 depends on the volumetric resistivity of the toner used and the polarity to which the image bearing member 6 is charged, but is chosen so as to be spaced in rank from the toner material on the triboelectric series. By way of example, where the image bearing member 6 comprises a selenic photoconductive material, the photoconductive member is charged to the positive polarity as is the electrostatic image, so that the toner 2 is charged to the negative polarity. This is accomplished by choosing a material for the triboelectric charging member 5 which is in a rank above the toner in the triboelectric series.

In the embodiment shown, a polystyrene toner has been used which has a specific resistivity of $10^{12}\Omega$cm. Teflon (trademark of Du Pont) may be used for the charging member in order to charge the toner to the positive polarity while Nylon (trademark of Du Pont) may be used for the charging member in order to charge the toner to the negative polarity.

When the toner 2 on the roller 1 is charged to the positive polarity by the charging member 5, the member is charged to the negative polarity, whereby an electrostatic attraction acts between the toner and the charging member. Thus, in order to charge the toner to a given polarity and to retain it on the developing roller 1, it is necessary that the surface of the developing roller have a greater toner retaining capability than that of the surface of the triboelectric charging member. This result can be attained by choosing materials for the developing roller 1 and the triboelectric charging member 5 which are spaced from the toner in the triboelectric series, with the attendant requirement that the material for the developing roller 1 be located at a higher rank than the charging member 5 in the same series. The toner retaining capability of the developing roller depends not only on the interaction with the toner, but also on the physical or chemical adherence of the toner to the rubber surface. A similar situation exists between the electrostatic attraction of the electrostatic image to the toner and the toner retaining capability of the rubber roller 1. In order to achieve the deposition of the charged toner on the electrostatic image, it is essential that the electrostatic attraction exerted by the electrostatic image be greater than the toner retaining capability of the rubber roller 1, which however is usually the case.

Figure 2:
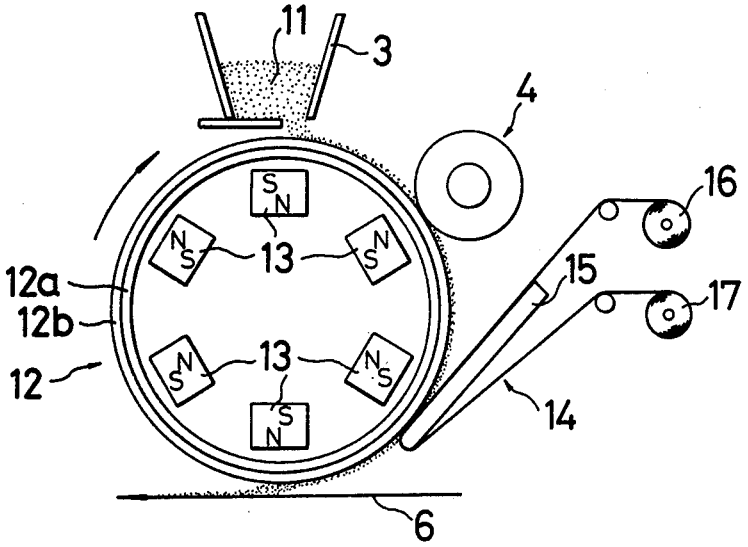
FIG. 2 is a similar schematic view to FIG. 1 showing another embodiment of the invention.

FIG. 2 is a schematic view of another embodiment of the invention, which differs from the previous embodiment in that a magnetic toner 11 is used, with a plurality of magnets 13 disposed within the hollow space of a developing roller 12 to form a magnetic brush thereon. In addition, a triboelectric charging member 14 of a displaceable type is used so that an unused surface or cleaned surface of the charging member may be successively presented for contact with the magnetic brush layer, thereby charging the magnetic toner. The developing roller 12 comprises a non-magnetic cylinder 12*a*, the surface of which is coated with an elastic rubber layer 12*b*.

The triboelectric charging member 14 comprises a support plate 15 having part thereof disposed adjacent the surface of the developing roller 12, a roll of plastic film 16, which extends so as to be supported by the plate 15 for contact with the toner layer on the roller surface, and a take-up roll 17 for taking up the film 16. In this manner, by rotating the roll 17 intermittently to present a fresh film surface, the toner layer on the developing roller can be triboelectrically charged. This prevents an excessive deposition of the toner onto the charging member as a result of the charging action thereof, and assures a stabilized charging characteristic. Alternatively, the charging member may be in the form of an endless belt associated with cleaning means, thereby presenting successive cleaned portions of the charging member for triboelectric charging of the toner.

Figure 3:
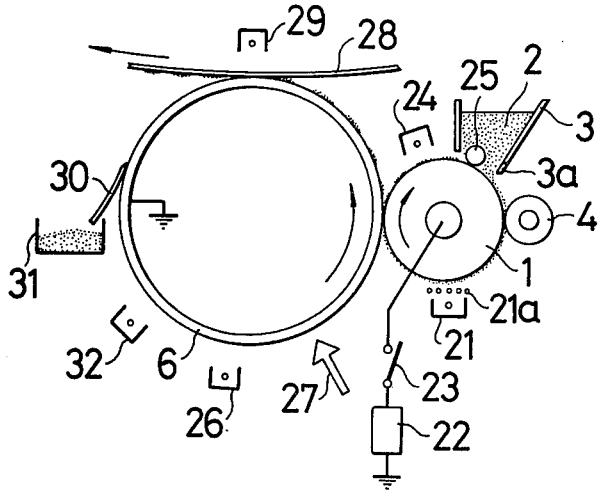
FIG. 3 is a similar schematic view showing an electrophotographic system which is provided with a further embodiment of the invention.

FIG. 3 is a schematic view of an electrophotographic copying machine incorporating a developing apparatus according to a further embodiment of the invention. A nonmagnetic toner 2 is used in this apparatus as in the embodiment of FIG. 1. Referring to FIG. 3, the clearance between the end 3*a* of the hopper and the rubber roller 1 is reduced to a minimal gap, desirably, on the order of about 0.03 to 0.06mm. After passage through the clearance, the toner layer on the rubber roller is levelled by the levelling member 4 and is charged to a given polarity by scorotron charger 21. The scorotron charger has a grid 21*a* which controls the degree of corona discharge and is preferably used for charging the toner since the toner will be sputtered about excessively if a usual corona charger is used. However, the triboelectric charging member as shown in FIGS. 1 and 2 may be used as means for charging the toner. When corona discharge is utilized for the toner charging, there is no need for the triboelectric series to be considered in choosing a material for the roller 1.

When charging the toner with scorotron charger 21, it is necessary to use an electrically conductive rubber roller for the roller 1 to provide a counter electrode for the charger 21. The use of a conductive roller permits a biased developing process to be performed to avoid background smearing or scumming, by applying a suitable voltage thereto from a voltage source 22. A switch 23 is connected between the roller and the source 22, and is closed in timed relationship with the developing process on the photosensitive member 6. After contributing to the developing step, the toner layer on the rubber roller is fully neutralized by a neutralizing charger 24 before entering the hopper 3. In order to assure a satisfactory developing result, it is necessary that the individual particles in the toner layer be uniformly charged. Unless the neutralizing charger 24 is used, the toner which has been supplied anew from the hopper may be charged to a different level from the toner which has been charged during the previous cycle. The neutralized toner layer is either partly or entirely scraped off the roller surface by a scraping member 25 which is disposed within the toner supply unit 3 in contact with the roller surface or in close proximity thereto within a distance less than the thickness of the toner layer.

Figure 4:
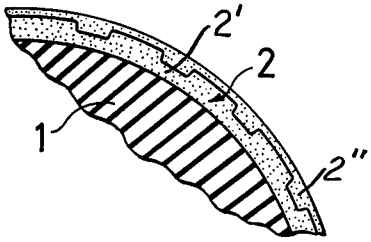
FIGS. 4 and 5 are fragmentary views showing the relationship between a toner layer on the developing roller and a subsequently deposited toner layer after the completion of the developing step.
Figure 5:
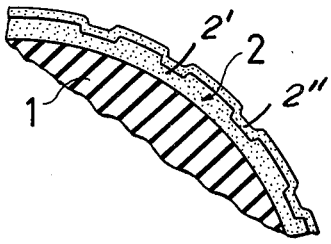
Figure 6:
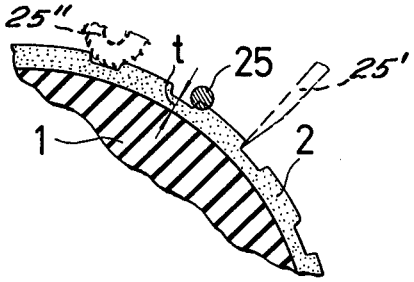
FIG. 6 is a fragmentary view showing the mounting position of a scraper member.

Generally, unevenness is formed in the toner layer of the developing roller when the developing is completed since part of the toner is carried away with the latent image. This unevenness is illustrated in the toner layer 2' shown in FIGS. 4 and 5. When the additional amount of toner is supplied from the hopper onto the developing roller, there results an unevenness in the outer surface of the additional layer of toner 2'' as illustrated in FIG. 5, rather than the forming of a smooth, continuous surface as illustrated in FIG. 4. This is attributable to poor flowability of the toner, and the tendency of the toner to agglomerate within the hopper. When a developing of the latent image takes place under this condition, there results in undeveloped areas thereof, which is undesirable. In order to prevent this unevenness in the toner layer on the developing roller which is produced as a result of the previous developing step the excess toner is removed, and toner is supplied anew onto the developing roller. The scraping member 25 is used for this purpose. The scraping member shown in FIG. 3 comprises a single wire, which is mounted at a position shown in FIG. 6 in which the lowest point thereof is located within the thickness *t* of the unevenness formed in the toner layer. The wire may be disposed in contact with the lower surface. A blade 25' or a wheel 25'' having an unevenness on its peripheral surface, such as shown in dotted lines in FIG. 6, may be substituted for the wire. The blade is similarly located within the hopper in a manner such that its inner end removes or stirs the layer of toner which remains after some of the toner has been carried away by the electrostatic latent image. In addition, a roller having a roughened surface or projections may be used as a scraping member. Such roller may be disposed stationary or may be rotated in the same or reverse direction to the direction of rotation of the developing roller. Similarly, an impeller may be used in place of such roller. To improve the flowability of the toner within the hopper, the scraping member or the hopper may be subjected to oscillations.

With continued reference to FIG. 3, the photoconductive member 6 is in the form of a drum having a surface formed of selenium, zinc oxide or organic photoconductor. The drum is adapted to rotate counterclockwise as shown. It is initially charged by a charger 26, and is then exposed to an optical image 27 to have an electrostatic latent image formed thereon, which is then converted into a visual image by using the developing apparatus according to the invention. Subsequently, a transfer corona charger 29 is utilized to charge a record on the back to the opposite polarity from that of the toner, whereby the visual image is transferred onto the front surface of the sheet 28. The transferred toner image is permanently fixed on the sheet by a fixing unit, not shown. Subsequent to the completion of the transfer step, residual toner on the photosensitive member 6 is removed therefrom by a doctor blade 30 which is held in abutment thereagainst, the removed toner being collected in a container 31. After the removal of the toner, the photosensitive member 6 is subjected to a neutralization step by a neutralizing charger 32, and is then again used in a repeated imaging cycle.

Representing the speed of movement of the photosensitive member 6 by $V_P$, and that of the rubber roller 1 by $V_R$, it is essential that $V_R/V_P \geqq 1.0$. A satisfactory image free from scumming and having a full density is obtained for $V_R \simeq 2V_P$.

As mentioned previously, a suitable material for the rubber roller 1 includes silicone rubber and chloroprene. While these materials do not exhibit substantial difference in fuction during the initial phase of use, the roller formed of chloroprene has a tendency to have a toner film formed on its surface after prolonged use, presenting a black lustre and making it difficult to provide an additional supply of toner to the roller surface. This resulted in the failure to increase the optical density even after repeated developing steps. On the contrary, the roller formed of silicone rubber did not exhibit such difficulty.

It is found that this is attributable to the affinity between an additive contained in the rubber and a toner component. Specifically, silicone oil contained as an additive in silicone rubber has a poor affinity with toner which, aided by the release capability of silicone rubber, prevents the formation of a toner film on the roller from occurring. As a consequence, no aging effect results after use over a prolonged period of time. Thus it is important to select an additive to the material of the roller which has a poor affinity with the toner material.

What is claimed is:

1. An apparatus for developing an electrostatic image on an electrostatic image bearing member, comprising:

a rotatable developing roller disposed adjacent said electrostatic image bearing member, at least the surface of the roller being formed of an elastic rubber and containing an additive which improves its release capability with respect to a toner;

supply means for uniformly supplying to the surface of the developing roller one-component developer having a volumetric resistivity of not less than $10^6$ Ω cm;

charging means disposed forwardly of the location of the supply means as viewed in the direction of rotation of the developing roller for charging the developer on the developing roller to the opposite polarity from the polarity of the electric charge which forms an electrostatic image on said image bearing member; and means for rotating the developing roller in a manner such that the ratio of the peripheral speed of the developing roller to the speed of movement of the image bearing member is equal to or greater than 1.0.

2. An apparatus according to claim 1 in which the developing roller is electrically conductive and is applied with a bias voltage.

3. An apparatus according to claim 1 in which the supply means includes a scraping means within its interior for stirring the developer and scraping the toner mechanically from the surface of the developing roller.

4. An apparatus according to claim 1 further including means for eliminating an electric charge from the developer remaining on the developing roller subsequent to the developing step and prior to its return to the supply means on the surface of the developing roller.

5. An apparatus according to claim 4 in which the charge eliminating means comprises a corona discharger.

6. An apparatus for developing an electrostatic image on an electrostatic image bearing member, comprising:

a rotatable developing roller disposed adjacent said electrostatic image bearing member, at least the entire surface of the roller being formed of a smooth continuous uniform layer of rubber having a high coefficient of friction;

supply means for uniformly supplying to the surface of the developing roller one-component developer having a volumetric resistivity of not less than $10^6$ Ω cm;

charging means disposed forwardly of the location of the supply means as viewed in the direction of rotation of the developing roller for charging the developer on the developing roller to the opposite polarity from the polarity of the electric charge which forms an electrostatic image on said image bearing member; and means for rotating the developing roller in a manner such that the ratio of the peripheral speed of the developing roller to the speed of movement of the image bearing member is equal to or greater than 1.0.

7. An apparatus for developing an electrostatic image on an electrostatic image bearing member, comprising:

a rotatable developing roller disposed adjacent said electrostatic image bearing member, at least the surface of the roller being formed of silicone rubber;

supply means for uniformly supplying to the surface of the developing roller one-component developer having a volumetric resistivity of not less than $10^6$ Ω cm;

charging means disposed forwardly of the location of the supply means as viewed in the direction of rotation of the developing roller for charging the developer on the developing roller to the opposite polarity from the polarity of the electric charge which forms an electrostatic image on said image bearing member; and means for rotating the developing roller in a manner such that the ratio of the peripheral speed of the developing roller to the speed of movement of the image bearing member is equal to or greater than 1.0.

8. An apparatus for developing an electrostatic image on an electrostatic image bearing member, comprising:

a rotatable developing roller disposed adjacent said electrostatic image bearing member, at least the surface of the roller being formed of an elastic rubber;

supply means for uniformly supplying to the surface of the developing roller one-component developer which comprises a non-magnetic toner having a volumetric resistivity of not less than $10^6$ Ω cm;

charging means disposed forwardly of the location of the supply means as viewed in the direction of rotation of the developing roller for charging the developer on the developing roller to the opposite polarity from the polarity of the electric charge which forms an electrostatic image on said image bearing member; and means for rotating the developing roller in a manner such that the ratio of the peripheral speed of the developing roller to the speed of movement of the image bearing member is equal to or greater than 1.0.

9. An apparatus for developing an electrostatic image on an electrostatic image bearing member, comprising:

a rotatable developing roller disposed adjacent said electrostatic image bearing member, and having a hollow internal space with at least the surface of the roller being formed of an elastic rubber;

supply means for uniformly supplying to the surface of the developing roller one-component developer which comprises a magnetic toner having a volumetric resistivity of not less than $10^6$ Ω cm;

a plurality of magnets disposed within said hollow internal space in the developing roller;

charging means in the form of a blade in forced abutment with the developing roller disposed forwardly of the location of the supply means as viewed in the direction of rotation of the developing roller for triboelectrically charging the developer on the developing roller to the opposite polarity from the polarity of the electric charge which forms an electrostatic image on said image bearing member; and means for rotating the developing roller in a manner such that the ratio of the peripheral speed of the developing roller to the speed of movement of the image bearing member is equal to or greater than 1.0.

10. An apparatus for developing an electrostatic image on an electrostatic image bearing member, comprising:

a rotatable developing roller disposed adjacent said electrostatic image bearing member, at least the surface of the roller being formed of an elastic rubber;

supply means for uniformly supplying to the surface of the developing roller one-component developer having a volumetric resistivity of not less than $10^6$ Ω cm;

charging means in the form of a triboelectric charging member which comprises a displaceable surface so that an unused portion thereof may be presented for use disposed forwardly of the location of the supply means as viewed in the direction of rotation of the developing roller for triboelectrically charging the developer on the developing roller to the opposite polarity from the polarity of the electric charge which forms an electrostatic image on said image bearing member; and means for rotating the developing roller in a manner such that the ratio of the peripheral speed of the developing roller to the speed of movement of the image bearing member is equal to or greater than 1.0.

11. An apparatus for developing an electrostatic image on an electrostatic image bearing member, comprising:

a rotatable developing roller disposed adjacent said electrostatic image bearing member, at least the surface of the roller being formed of an elastic rubber;

supply means for uniformly supplying to the surface of the developing roller one-component developer having a volumetric resistivity of not less than $10^6$ Ω cm;

charging means which comprises a corona discharger disposed forwardly of the location of the supply means as viewed in the direction of rotation of the developing roller for charging the developer on the developing roller to the opposite polarity from the polarity of the electric charge which forms an electrostatic image on said image bearing member; and means for rotating the developing roller in a manner such that the ratio of the peripheral speed of the developing roller to the speed of movement of the image bearing member is equal to or greater than 1.0.

12. An apparatus for developing an electrostatic image on an electrostatic image bearing member, comprising:

a rotatable developing roller disposed adjacent said electrostatic image bearing member, at least the surface of the roller being formed of an elastic rubber;

supply means for uniformly supplying to the surface of the developing roller one-component developer having a volumetric resistivity of not less than $10^6$ Ω cm;

charging means which comprises a scorotron discharger disposed forwardly of the location of the supply means as viewed in the direction of rotation of the developing roller for charging the developer on the developing roller to the opposite polarity from the polarity of the electric charge which forms an electrostatic image on said image bearing member; and means for rotating the developing roller in a manner such that the ratio of the peripheral speed of the developing roller to the speed of movement of the image bearing member is equal to or greater than 1.0.

13. An apparatus for developing an electrostatic image on an electrostatic image bearing member, comprising:

a rotatable developing roller disposed adjacent said electrostatic image bearing member, at least the surface of the roller being formed of an elastic rubber;

supply means for uniformly supplying to the surface of the developing roller one-component developer having a volumetric resistivity of not less than $10^6$ Ω cm;

charging means disposed forwardly of the location of the supply means as viewed in the direction of rotation of the developing roller for charging the developer on the developing roller to the opposite polarity from the polarity of the electric charge which forms an electrostatic image on said image bearing member; and means for rotating the developing roller in a manner such that the ratio of the speeds of movement of the surfaces of the developing roller and the imaging bearing member is about 2.

14. An apparatus for developing an electrostatic image on an electrostatic image bearing member, comprising:

a rotatable developing roller disposed adjacent said electrostatic image bearing member, at least the surface of the roller being formed of an elastic rubber;

supply means for uniformly supplying to the surface of the developing roller one-component developer having a volumetric resistivity of not less than $10^6$ Ω cm;

charging means disposed forwardly of the location of the supply means as viewed in the direction of rotation of the developing roller for charging the developer on the developing roller to the opposite polarity from the polarity of the electric charge which forms an electrostatic image on said image bearing member;

means for rotating the developing roller in a manner such that the ratio of the peripheral speed of the developing roller to the speed of movement of the image bearing member is equal to or greater than 1.0; and levelling means interposed between the supply means and the charging means and disposed adjacent said roller surface with a gap of less than 100 microns therebetween for uniformly levelling the developer on the developing roller.

15. An apparatus according to claim 14 in which the levelling means comprises a roller which remains stationary and the developer on the developing roller is triboelectrically charged to a given polarity.

16. An apparatus for developing an electrostatic image on an electrostatic image bearing member, comprising:

a rotatable developing roller disposed adjacent said electrostatic image bearing member, at least the surface of the roller being formed of an elastic rubber;

supply means for uniformly supplying to the surface of the developing roller one-component developer having a volumetric resistivity of not less than $10^6$ Ω cm;

charging means disposed forwardly of the location of the supply means as viewed in the direction of rotation of the developing roller for charging the developer on the developing roller to the opposite polarity from the polarity of the electric charge which forms an electrostatic image on said image bearing member;

means for rotating the developing roller in a manner such that the ratio of the peripheral speed of the developing roller to the speed of movement of the image bearing member is equal to or greater than 1.0; and a scraping means in the form of a wire within the supply means for stirring the developer therein.

17. An apparatus according to claim 3 in which the scraping member is in the form of a blade.

18. An apparatus for developing an electrostatic image on an electrostatic image bearing member, comprising:

a rotatable developing roller disposed adjacent said electrostatic image bearing member, at least the surface of the roller being formed of an elastic rubber;

supply means for uniformly supplying to the surface of the developing roller one-component developer having a volumetric resistivity of not less than $10^6$ Ω cm;

charging means disposed forwardly of the location of the supply means as viewed in the direction of rotation of the developing roller for charging the developer on the developing roller to the opposite polarity from the polarity of the electric charge which forms an electrostatic image on said image bearing member;

means for rotating the developing roller in a manner such that the ratio of the peripheral speed of the developing roller to the speed of movement of the image bearing member is equal to or greater than 1.0; and a scraping means in the form of a wheel having unevenness on its peripheral surface within the supply means for stirring the developer therein.

19. An apparatus for developing an electrostatic image on an electrostatic image bearing member, comprising:

an electrically conductive roller formed of elastic silicone rubber and disposed close to said electrostatic image bearing member;

means for uniformly supplying to the roller surface a non-magnetic toner having a volumetric resistivity of not less than $10^6$ Ω cm;

a scraping means disposed within the supply means for stirring the toner on the rubber roller;

a levelling means for levelling the toner supplied onto the rubber roller;

scorotron discharger means for charging the toner on the rubber roller to the opposite polarity from the polarity of the electric charge which forms an electrostatic image on said image bearing member;

a corona discharger for eliminating an electric charge from the toner remaining on the rubber roller subsequent to the developing step; and bias means for selectively applying a bias voltage to the rubber roller.

* * * * *